US010441853B2

(12) United States Patent
Watanabe

(10) Patent No.: US 10,441,853 B2
(45) Date of Patent: Oct. 15, 2019

(54) MULTI-PIECE SOLID GOLF BALL

(71) Applicant: Bridgestone Sports Co., Ltd., Tokyo (JP)

(72) Inventor: Hideo Watanabe, Saitamaken (JP)

(73) Assignee: Bridgestone Sports Co., Ltd., Minato-ku, Tokyo (JP)

( * ) Notice: Subject to any disclaimer, the term of this patent is extended or adjusted under 35 U.S.C. 154(b) by 0 days.

(21) Appl. No.: 15/880,649

(22) Filed: Jan. 26, 2018

(65) Prior Publication Data

US 2018/0256944 A1 Sep. 13, 2018

(30) Foreign Application Priority Data

Mar. 10, 2017 (JP) ..... 2017-045901

(51) Int. Cl.
*A63B 37/00* (2006.01)

(52) U.S. Cl.
CPC ..... *A63B 37/0092* (2013.01); *A63B 37/0024* (2013.01); *A63B 37/0031* (2013.01); *A63B 37/0043* (2013.01); *A63B 37/0062* (2013.01); *A63B 37/0063* (2013.01); *A63B 37/0065* (2013.01); *A63B 37/0076* (2013.01); *A63B 37/0081* (2013.01); *A63B 37/0083* (2013.01)

(58) Field of Classification Search
CPC ..... A63B 37/0076; A63B 37/0092
See application file for complete search history.

(56) References Cited

U.S. PATENT DOCUMENTS

| | | | | |
|---|---|---|---|---|
| 6,527,652 | B1 * | 3/2003 | Maruko | A63B 37/0003 473/371 |
| 6,565,455 | B2 | 5/2003 | Hayashi et al. | |
| 6,565,456 | B2 | 5/2003 | Hayashi et al. | |
| 7,563,180 | B2 | 7/2009 | Watanabe et al. | |
| 7,708,655 | B2 | 5/2010 | Kasashima et al. | |
| 7,833,112 | B2 | 11/2010 | Sullivan et al. | |
| 7,967,701 | B2 | 6/2011 | Sullivan et al. | |

(Continued)

FOREIGN PATENT DOCUMENTS

| | | |
|---|---|---|
| JP | 2001-218872 A | 8/2001 |
| JP | 2001-218873 A | 8/2001 |

(Continued)

OTHER PUBLICATIONS

Compressions by Any Other Name—J. Dalton.*

*Primary Examiner* — John E Simms, Jr.
(74) *Attorney, Agent, or Firm* — Sughrue Mion, PLLC

(57) ABSTRACT

In a multi-piece solid golf ball having a core and four successive layers encasing the core—an inner envelope layer, an outer envelope layer, an intermediate layer and a cover, the inner envelope, outer envelope and intermediate layer are each formed of different highly neutralized resin materials, and the cover thickness is larger than the respective thicknesses of the inner envelope layer, outer envelope layer and intermediate layer. Also, the value (A)–(B) obtained by subtracting the material hardness (B) of the softest layer among the inner envelope layer, outer envelope layer and intermediate layer from the material hardness (A) of the cover is a Shore D hardness of 13 or more. This golf ball holds down the spin rate on full shots with a driver by amateur golfers having modest head speeds, and also has a soft and good feel at impact.

18 Claims, 1 Drawing Sheet

(56) References Cited

U.S. PATENT DOCUMENTS

| | | | | |
|---|---|---|---|---|
| 8,123,630 | B2 | 2/2012 | Watanabe | |
| 2009/0111611 | A1* | 4/2009 | Kimura | A63B 37/0004 473/373 |
| 2012/0157233 | A1* | 6/2012 | Watanabe | A63B 37/0031 473/373 |
| 2013/0029787 | A1* | 1/2013 | Watanabe | A63B 37/0031 473/373 |
| 2013/0274032 | A1 | 10/2013 | Kasashima et al. | |
| 2015/0065268 | A1* | 3/2015 | Nakajima | A63B 37/006 473/373 |
| 2017/0368420 | A1* | 12/2017 | Tago | A63B 37/0038 |

FOREIGN PATENT DOCUMENTS

| | | | |
|---|---|---|---|
| JP | 2005-211656 | A | 8/2005 |
| JP | 2010-253268 | A | 11/2010 |
| JP | 2013-220353 | A | 10/2013 |

* cited by examiner

MULTI-PIECE SOLID GOLF BALL

CROSS-REFERENCE TO RELATED APPLICATION

This non-provisional application claims priority under 35 U.S.C. § 119(a) on Patent Application No. 2017-045901 filed in Japan on Mar. 10, 2017, the entire contents of which are hereby incorporated by reference.

TECHNICAL FIELD

This invention relates to a multi-piece solid golf ball having a core and four layers that encase the core: an inner envelope layer, an outer envelope layer, an intermediate layer and a cover.

BACKGROUND ART

A variety of golf balls has hitherto been developed. Of these, functional multi-piece solid golf balls having an optimized hardness relationship among a plurality of layers encasing the core, such as an intermediate layer and a cover, are widely used. In addition, three-piece solid golf balls which use as the intermediate layer material a highly neutralized resin material containing an ionomeric resin or a non-ionomeric resin as the base resin and, added thereto, an organic acid or a metal salt thereof and a basic inorganic metal compound capable of neutralizing acid groups, and which have a soft compression, are highly regarded on the market. Examples of such golf balls include the four-piece solid golf ball which uses highly neutralized resin materials in the intermediate layer and the envelope layer that is disclosed in JP-A 2010-253268.

U.S. Pat. Nos. 7,967,701 and 7,833,112 disclose four-piece solid golf balls in which two of the three layers in the core are made of highly neutralized resin materials. Also, U.S. Pat. No. 7,708,655, JP-A 2001-218872, JP-A 2001-218873, JP-A 2005-211656 and JP-A 2013-220353 describe three-piece solid golf balls or four-piece solid golf balls which use a highly neutralized resin material in the intermediate layer or the envelope layer.

However, none of these patent publications make any mention of a five-piece golf ball having at the interior three layers of highly neutralized resin materials. Moreover, there exists a desire for a further increase in the distance traveled by the golf ball and for further improvement in the feel of the ball at impact.

SUMMARY OF THE INVENTION

It is therefore an object of the present invention to provide a multi-piece solid golf ball which, when hit with a driver (W#1) by an amateur golfer whose head speed is not very fast, is able to confer a soft and good feel at impact while maintaining a good distance.

As a result of intensive investigations, the inventors have discovered that, by encasing the core within four layers—these being an inner envelope layer, an outer envelope layer, an intermediate layer and a cover, by forming the inner envelope layer, the outer envelope layer and the intermediate layer of respectively different highly neutralized resin materials, by making the thickness of the cover greater than the respective thicknesses of the inner envelope layer, the outer envelope layer and the intermediate layer, and moreover by setting the value (A)−(B) obtained by subtracting the material hardness (B) of the softest layer among the inner envelope layer, the outer envelope layer and the intermediate layer from the material hardness (A) of the cover to a Shore D hardness value of 13 or more, there can be obtained a golf ball which holds down the spin rate on full shots by amateur golfers whose head speed is not very fast, particularly those having a head speed of 35 m/s or less, and which moreover has a soft and good feel at impact.

In a more preferred aspect of the invention, by forming three layers at the golf ball interior of highly neutralized resin materials such that the respective layers become harder from the inner side toward the outer side of the ball, the spin rate of the ball on full shots can be held down. In addition, as a further modification for holding down the spin rate on full shots, by setting the hardnesses of these layers within specific ranges while taking into consideration both the somewhat hard ionomer cover and the hardness profile of the core, and also by setting the core deflection when compressed under a given load to 4.0 mm or more, it is even more possible to suppress the spin rate on full shots and to obtain a soft and good feel at impact.

Accordingly, the invention provides a multi-piece solid golf ball having a core and four successive layers encasing the core—an inner envelope layer, an outer envelope layer, an intermediate layer and a cover, wherein the inner envelope layer, the outer envelope layer and the intermediate layer are each formed of different highly neutralized resin materials; the cover has a larger thickness than the respective thicknesses of the inner envelope layer, the outer envelope layer and the intermediate layer; and the value (A)−(B) obtained by subtracting the material hardness (B) of the softest layer among the inner envelope layer, the outer envelope layer and the intermediate layer from the material hardness (A) of the cover is a Shore D hardness of 13 or more.

In a preferred embodiment of the golf ball of the invention, the material hardnesses of the respective layers and the center hardness of the core satisfy the following condition:

cover material hardness>intermediate layer material hardness>outer envelope layer material hardness>inner envelope layer material hardness>core center hardness.

In another preferred embodiment of the inventive golf ball, the material hardness of the cover on the Shore D hardness scale is at least 55.

In yet another preferred embodiment, the material hardness of the intermediate layer on the Shore D hardness scale is from 50 to 60.

In still another preferred embodiment, the material hardness of the outer envelope layer on the Shore D hardness scale is from 45 to 57.

In a further preferred embodiment, the material hardness of the inner envelope layer on the Shore D hardness scale is from 40 to 52.

In a still further preferred embodiment, letting the JIS-C hardness at the core center be Cc, the JIS-C hardness at a position 5 mm from the core center be C5, the JIS-C hardness at a position 10 mm from the core center be C10, the JIS-C hardness at a position 15 mm from the core center be C15 and the JIS-C hardness at the core surface be Cs, the core has a hardness profile which satisfies the following relationships (i) to (vi):

$$18 \leq Cs - Cc \quad \text{(i)}$$

$$0 \leq C10 - Cc \leq 10 \quad \text{(ii)}$$

$$C10 - Cc < Cs - C10 \quad \text{(iii)}$$

$$10<Cs-C10 \quad \text{(iv)}$$

$$Cs\geq 68 \quad \text{(v)}$$

$$Cc\geq 48. \quad \text{(vi)}$$

Here, it is desirable for Cs to be from 68 to 80, C15 to be from 64 to 78, C10 to be from 56 to 67, C5 to be from 52 to 63, Cc to be from 48 to 62, Cs−C15 to be from 1 to 9, C15−C10 to be from 4 to 15, C10−C5 to be from 1 to 7, C5−Cc to be from 0 to 7, (Cs−C10)/(C10−Cc) to be from 1.0 to 5.0, and Cs−Cc to be from 14 to 30.

In another preferred embodiment, the core has a deflection when compressed under a final load of 1.275 N (130 kgf) from an initial load of 98 N (10 kgf) that is at least 4.0 mm.

In yet another preferred embodiment, the core diameter, intermediate layer thickness and cover thickness satisfy the following relationship:

cover thickness>intermediate layer thickness<core diameter.

In still another preferred embodiment, the initial velocities of the sphere (I) consisting of the core encased by the inner envelope layer, the sphere (II) consisting of sphere (I) encased by the outer envelope layer, the sphere (III) consisting of sphere (II) encased by the intermediate layer, and the ball satisfy the following relationships:

ball initial velocity Sphere (*III*) initial velocity>Sphere (*II*) initial velocity≥Sphere (*I*) initial velocity; and ball initial velocity>core initial velocity.

In a further preferred embodiment, at least 50 wt % of the total amount of cover material is a high-acid ionomer resin having an acid content of at least 16 wt %.

Advantageous Effects of the Invention

The multi-piece solid golf ball of the invention holds down the spin rate on full shots with a driver (W#1) by amateur golfers whose head speed is not very fast, particularly those having a head speed of 35 m/s or less, and moreover has a soft and good feel at impact.

BRIEF DESCRIPTION OF THE DIAGRAMS

DESCRIPTION OF THE PREFERRED EMBODIMENTS

The objects, features and advantages of the invention will become more apparent from the following detailed description taken in conjunction with the appended diagrams.

Figure 1:
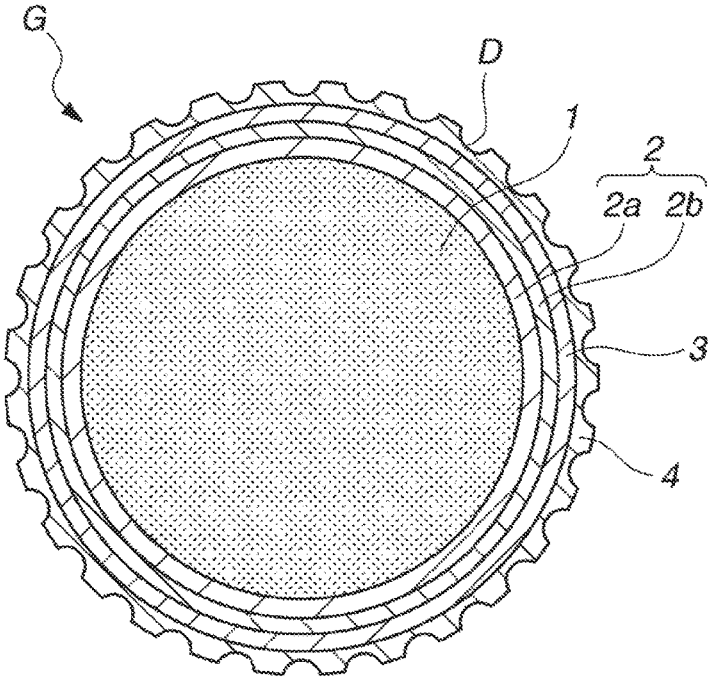
FIG. 1 is a schematic cross-sectional view of a golf ball according to one embodiment of the invention.

The multi-piece solid golf ball of the invention has, from the inside: a core, an envelope layer, an intermediate layer and a cover. Referring to FIG. 1, the golf ball G has a core 1 and four layers that encase the core 1: an envelope layer 2 which directly encases the core 1 and is itself composed of an inner envelope layer 2*a* and an outer envelope layer 2*b*, an intermediate layer 3 which encases the envelope layer 2, and a cover 4 which encases the intermediate layer 3. In addition, the golf ball typically has numerous dimples D formed on the outer surface of the cover 4 in order to enhance the aerodynamic properties. Each layer is described in detail below.

The core is composed primarily of a base rubber, and may be formed using a rubber composition which includes, together with the base rubber, known compounding ingredients such as a co-crosslinking agent, an organic peroxide, an inert filler, sulfur, an antioxidant, and an organosulfur compound.

In the practice of this invention, it is especially preferable to use a rubber composition containing compounding ingredients (A) to (C) shown below:

(A) a base rubber (B) an organic peroxide (C) water and/or a metal monocarboxylate.

The base rubber serving as component (A) is not particularly limited, although the use of polybutadiene is especially preferred.

It is desirable for the polybutadiene to have a cis-1,4 bond content on the polymer chain of typically at least 60 wt %, preferably at least 80 wt %, more preferably at least 90 wt %, and most preferably at least 95 wt %. When cis-1,4 bonds account for too few of the bonds on the polybutadiene molecule, the resilience may decrease.

Polybutadiene rubbers differing from the above may also be included in the base rubber. In addition, styrene-butadiene rubber (SBR), natural rubber, polyisoprene rubber, ethylene-propylene-diene rubber (EPDM) or the like may also be included. These may be used singly or two or more may be used in combination.

The organic peroxide (B) used in the invention, although not particularly limited, is preferably an organic peroxide having a one-minute half-life temperature of between 110 and 185° C. One, two or more organic peroxides may be used. The amount of organic peroxide included per 100 parts by weight of the base rubber is preferably at least 0.1 part by weight, and more preferably at least 0.3 part by weight. The upper limit is preferably not more than 5 parts by weight, more preferably not more than 4 parts by weight, and even more preferably not more than 3 parts by weight. A commercial product may be used as the organic peroxide. Specific examples include those available under the trade names Percumyl D, Perhexa C-40, Niper BW and Peroyl L (all products of NOF Corporation), and Luperco 231XL (from AtoChem Co.).

Next, the water which may be used as component (C) in the invention is not particularly limited, and may be distilled water or tap water. The use of distilled water that is free of impurities is especially preferred. The amount of water included per 100 parts by weight of the base rubber is preferably at least 0.1 part by weight, and more preferably at least 0.3 part by weight. The upper limit is preferably not more than 5 parts by weight, more preferably not more than 4 parts by weight, and even more preferably not more than 3 parts by weight.

By including a suitable amount of such water, the moisture content in the rubber composition before vulcanization becomes preferably at least 1,000 ppm, and more preferably at least 1,500 ppm. The upper limit is preferably not more than 8,500 ppm, and more preferably not more than 8,000 ppm. When the moisture content of the rubber composition is too low, it may be difficult to obtain a suitable crosslink density and tan δ, which may make it difficult to mold a golf ball that minimizes energy loss and has a reduced spin rate. On the other hand, when the moisture content of the rubber composition is too high, the core may be too soft, which may make it difficult to obtain a suitable core initial velocity.

Although it is also possible to add water directly to the rubber composition, the following methods (i) to (iii) may be employed to incorporate water:

(i) applying water in the form of a mist, as steam or by means of ultrasound, to some or all of the rubber composition (compounded material);

(ii) immersing some or all of the rubber composition in water;

(iii) letting some or all of the rubber composition stand for a given period of time in a high-humidity environment in a place where the humidity can be controlled, such as a constant humidity chamber.

As used herein, "high-humidity environment" is not particularly limited, so long as it is an environment capable of moistening the rubber composition, although a humidity of from 40 to 100% is preferred.

Alternatively, the water may be worked into a jelly state and added to the above rubber composition. Or a material obtained by first supporting water on a filler, unvulcanized rubber, rubber powder or the like may be added to the rubber composition. In such a form, the workability is better than when water is directly added to the composition, enabling the efficiency of golf ball production to be increased. The type of material in which a given amount of water has been included, although not particularly limited, is exemplified by fillers, unvulcanized rubbers and rubber powders in which sufficient water has been included. The use of a material which undergoes no loss of durability or resilience is especially preferred. The moisture content of the above material is preferably at least 3 wt %, more preferably at least 5 wt %, and even more preferably at least 10 wt %. The upper limit is preferably not more than 99 wt %, and even more preferably not more than 95 wt %.

Alternatively, a metal monocarboxylate may be used instead of the above-described water. Metal monocarboxylates, in which the carboxylic acid is presumably coordination-bonded to the metal, are distinct from metal dicarboxylates such as zinc diacrylate of the formula $(CH_2{=}CHCOO)_2Zn$. A metal monocarboxylate introduces water into the rubber composition by way of a dehydration/condensation reaction, and thus provides an effect similar to that of water. Moreover, because a metal monocarboxylate can be added to the rubber composition as a powder, the operations can be simplified and uniform dispersion within the rubber composition is easy. In order to carry out the above reaction effectively, a monosalt is required. The amount of metal monocarboxylate included per 100 parts by weight of the base rubber is preferably at least 1 part by weight, and more preferably at least 3 parts by weight. The upper limit in the amount of metal monocarboxylate included is preferably not more than 60 parts by weight, and more preferably not more than 50 parts by weight. When the amount of metal monocarboxylate included is too small, it may be difficult to obtain a suitable crosslink density and tan δ, as a result of which a sufficient golf ball spin rate-lowering effect may not be achievable. On the other hand, when too much is included, the core may become too hard, as a result of which it may be difficult for the ball to maintain a suitable feel at impact.

The carboxylic acid used may be, for example, acrylic acid, methacrylic acid, maleic acid, fumaric acid or stearic acid. Examples of the substituting metal include sodium, potassium, lithium, zinc, copper, magnesium, calcium, cobalt, nickel and lead, although the use of zinc is preferred. Illustrative examples of the metal monocarboxylate include zinc monoacrylate and zinc monomethacrylate, with the use of zinc monoacrylate being especially preferred.

The core in the invention can be obtained by vulcanizing/curing the above-described rubber composition by a method similar to that used for known golf ball rubber compositions. The conditions under which vulcanization is carried out are exemplified by a vulcanization temperature of between 100 and 200° C. and a vulcanization time of from 5 to 40 minutes.

The core diameter, although not particularly limited, is generally from 32.7 to 36.7 mm, preferably from 33.3 to 36.1 mm, and more preferably from 33.7 to 35.7 mm. When this diameter is too small, the spin rate on shots with a driver (W#1) rises, as a result of which the intended distance may not be obtained. On the other hand, when the core diameter is too large, the feel of the ball at impact may worsen.

The core deflection (mm) when compressed under a final load of 1,275 N (130 kgf) from an initial load of 98 N (10 kgf), although not particularly limited, is preferably from 4.0 to 5.4 mm, more preferably from 4.2 to 5.1 mm, and even more preferably from 4.4 to 4.8 mm. When this value is too large, the feel at impact may be too soft or the durability of the ball on repeated impact may worsen. On the other hand, when this value is too small, the spin rate on full shots increases, as a result of which the intended distance may not be obtained.

The initial velocity of the core may be measured using an initial velocity measuring apparatus of the same type as the USGA drum rotation-type initial velocity instrument approved by The Royal and Ancient Golf Club of St. Andrews (R&A). In such cases, the core may be tested in a room temperature (23.9±2° C.) chamber after being held isothermally at 23.9±1° C. for at least 3 hours. The core initial velocity is preferably at least 76.8 m/s, more preferably at least 77.0 m/s, and even more preferably at least 77.2 m/s. The upper limit is preferably not more than 77.9 m/s, more preferably not more than 77.7 m/s, and even more preferably not more than 77.5 m/s. At a core initial velocity higher than this range, the ball initial velocity may exceed the maximum value allowed forth under the Rules of Golf by the R&A, and may therefore not be acceptable as an official ball. On the other hand, at a core initial velocity smaller than the above range, the initial velocity of the ball on shots with a driver (W#1) becomes low, as a result of which a good distance may not be achieved.

It is desirable for the core of the inventive golf ball to have in particular a hardness profile in which the gradient from the core center to a specific position is not large, but the gradient from the specific position to the surface is steep. With this hardness profile, a reduction in the ball spin rate is fully achievable and a good flight performance can be obtained. The hardnesses at specific positions in the core interior are explained below.

The core surface hardness (Cs) on the JIS-C hardness scale is preferably from 68 to 80, more preferably from 70 to 78, and even more preferably from 72 to 76. When this core surface hardness on the JIS-C hardness scale is too large, the feel of the ball at impact may harden or the durability to cracking on repeated impact may worsen. On the other hand, when this value is too small, the spin rate may rise excessively and the rebound may decrease, resulting in a poor distance.

The core center hardness (Cc) on the JIS-C hardness scale is preferably from 48 to 62, more preferably from 51 to 60, and even more preferably from 53 to 58. When this core center hardness on the JIS-C hardness scale is too large, the spin rate may rise excessively, resulting in a poor distance, or the feel of the ball at impact may be too hard. On the other hand, when this value is too small, the durability of the ball to cracking on repeated impact may worsen or the feel at impact may be too soft.

The JIS-C hardness at a position 5 mm from the core center (C5) is preferably from 52 to 63, more preferably from 54 to 61, and even more preferably from 56 to 59. The JIS-C hardness at a position 10 mm from the core center (C10) is preferably from 56 to 67, more preferably from 58 to 65, and even more preferably from 60 to 63. When these hardness values are too large, the spin rate may rise excessively, resulting in a poor distance, or the feel at impact may be too hard. On the other hand, when this value is too small, the durability of the ball to cracking on repeated impact may worsen or the feel at impact may be too soft.

The JIS-C hardness at a position 15 mm from the core center (C15) is preferably from 64 to 78, more preferably from 66 to 76, and even more preferably from 68 to 74. When this hardness value is too large, the feel at impact may become hard or the durability to cracking on repeated impact may worsen. On the other hand, when this hardness value is too small, the spin rate may rise excessively or the rebound may become low, resulting in a poor distance.

The value Cs−C15 is preferably from 1 to 9, more preferably from 2 to 7, and even more preferably from 3 to 5. When this value is too large, the durability to cracking on repeated impact may worsen. On the other hand, when this value is too small, the spin rate may rise excessively, as a result of which a good distance may not be achieved.

The value C15−C10 is preferably from 4 to 15, more preferably from 6 to 13, and even more preferably from 8 to 11. When this value is too large, the durability to cracking on repeated impact may worsen. On the other hand, when this value is too small, the spin rate may rise excessively, as a result of which a good distance may not be achieved.

The value C10−C5 is preferably from 1 to 7, more preferably from 2 to 5, and even more preferably from 3 to 4. When this value is outside of the above range, the spin rate on full shots may rise excessively, as a result of which a good distance may not be achieved, or the durability to cracking on repeated impact may worsen.

The value C5−Cc is preferably from 0 to 7, more preferably from 1 to 5, and even more preferably from 2 to 3. When this value is too large, the spin rate may rise excessively, as a result of which a good distance may not be obtained. On the other hand, when this value is too small, the durability to cracking on repeated impact may worsen.

The value C10−Cc is preferably from 0 to 10, more preferably from 2 to 9, and even more preferably from 4 to 8. What this means is that the hardness gradient from the core center out to 10 mm is not very steep. When this value is too large, the spin rate may rise excessively, as a result of which a good distance may not be obtained. On the other hand, when this value is too small, the durability to cracking on repeated impact may worsen.

The value Cs−C10 is preferably from 10 to 25, more preferably from 11 to 20, and even more preferably from 12 to 15. What this means is that from a position 10 mm from the core center (C10) out to the core surface (Cs), there is a steep gradient of 10 or more on the JIS-C hardness scale. When this value is too large, the durability to cracking on repeated impact may worsen. On the other hand, when this value is too small, the spin rate on full shots may rise excessively, as a result of which a good distance may not be obtained.

It is essential for the value Cs−C10 to be larger than the value C10−Cc. This means that the hardness gradient is steeper to the outside of the core interior. That is, the value (Cs−C10)/(C10−Cc) is preferably larger than 1.0 and up to 5.0, more preferably from 1.2 to 4.0, and even more preferably from 1.5 to 3.0. When this value is too large, the durability to cracking on repeated impact may worsen. On the other hand, when this value is too small, the spin rate may rise excessively, as a result of which a good distance may not be achieved.

The hardness difference between the surface and center of the core, i.e., the value Cs−Cc, is preferably from 14 to 30, more preferably from 16 to 24, and even more preferably from 18 to 20. When this hardness difference value is too large, the durability to cracking on repeated impact may worsen. On the other hand, when this hardness difference value is too small, the spin rate may rise excessively, as a result of which a good distance may not be achieved.

The center hardness (Cc) and the hardnesses at specific cross-sectional positions refer to hardnesses measured at the center and specific positions in a cross-section obtained by cutting the core in half through the center. The surface hardness (Cs) refers to the hardness measured at the spherical surface of the core.

Next, with regard to the materials of the inner envelope layer, outer envelope layer and intermediate layer, in this invention, highly neutralized resin materials are utilized in all of these layers. Preferred use can be made of a highly neutralized material which contains, as an essential ingredient, a base resin of the following mixed in specific amounts: (a) an olefin-unsaturated carboxylic acid random copolymer and/or a metal ion neutralization product of an olefin-unsaturated carboxylic acid random copolymer, and (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer. The resin materials used to form the inner envelope layer, the outer envelope layer and the intermediate layer are of different types separately compounded for each layer in such a way as to set the subsequently described relationships among the material hardnesses of the respective layers and among the surface hardnesses of the respective encased spheres within specific ranges.

Commercial products may be used as components (a) and (b). Illustrative examples of the random copolymer in component (a) include Nucrel® N1560, N1214, N1035 and AN4221C (all products of DuPont-Mitsui Polychemicals Co., Ltd.). Illustrative examples of the random copolymer of component (b) include Nucrel® AN4311, AN4318 and AN4319 (all products of DuPont-Mitsui Polychemicals Co., Ltd.).

Illustrative examples of the metal ion neutralization product of the random copolymer in component (a) include Himilan® 1554, 1557, 1601, 1605, 1706 and MA7311 (all products of DuPont-Mitsui Polychemicals Co., Ltd.), and Surlyn® 7930 (E.I. DuPont de Nemours & Co.). Illustrative examples of the metal ion neutralization product of the random copolymer in component (b) include Himilan® 1855, 1856 and AM7316 (all products of DuPont-Mitsui Polychemicals Co., Ltd.), and Surlyn® 6320, 8320, 9320 and 8120 (all products of E.I. DuPont de Nemours & Co.). Sodium-neutralized ionomer resins that are suitable as metal ion neutralization products of these random copolymers include Himilan® 1605, 1601 and 1555.

When preparing the base resin, the weight ratio in which component (a) and component (b) are mixed may be set to generally between 100:0 and 0:100. The ratio of component (a) with respect to the combined amount of components (a)

and (b) may be set to preferably at least 50 wt %, more preferably at least 75 wt %, and most preferably 100 wt %.

A non-ionomeric thermoplastic elastomer (e) may be added to the base resin so as to enhance even further the feel of the ball on impact and the ball rebound. Examples of component (e) include olefin elastomers, styrene elastomers, polyester elastomers, urethane elastomers and polyamide elastomers. In this invention, to further increase the rebound, it is preferable to use a polyester elastomer or an olefin elastomer. The use of an olefin elastomer consisting of a thermoplastic block copolymer which includes crystalline polyethylene blocks as the hard segments is especially preferred.

A commercial product may be used as component (e). Examples include Dynaron (JSR Corporation) and the polyester elastomer Hytrel® (DuPont-Toray Co., Ltd.).

Component (e) may be included in an amount of 0 part by weight or more. There is no particular upper limit in the content thereof, although the amount of component (e) included per 100 parts by weight of the base resin may be set to preferably not more than 100 parts by weight, more preferably not more than 60 parts by weight, even more preferably not more than 50 parts by weight, and most preferably not more than 40 parts by weight. When the component (e) content is too high, the compatibility of the mixture may decrease and the durability of the golf ball may markedly decline.

A fatty acid or fatty acid derivative having a molecular weight of at least 228 and not more than 1,500 may be added as component (c) to the base resin. Compared with the base resin, this component (c) has a very low molecular weight; by suitably adjusting the melt viscosity of the mixture, it helps in particular to improve the flow properties. Also, component (c) includes a relatively high content of acid groups (or derivatives thereof), and is able to suppress an excessive loss of resilience.

The amount of component (c) included per 100 parts by weight of the resin component obtained by suitably blending components (a), (b) and (e) may be set to at least 5 parts by weight, preferably at least 10 parts by weight, more preferably at least 15 parts by weight, and even more preferably at least 18 parts by weight. The upper limit in the amount of component (c) may be set to not more than 100 parts by weight, preferably not more than 80 parts by weight, and more preferably not more than 60 parts by weight. When the amount of component (c) included is too low, the melt viscosity may decrease, lowering the processability; when the amount included is too high, the durability may decrease.

A basic inorganic metal compound capable of neutralizing acid groups in the base resin and component (c) may be added as component (d). By including component (d), the acid groups present in the base resin and component (c) are neutralized and, owing to synergistic effects from the blending of these components, the thermal stability of the resin composition increases. At the same time, a good moldability is imparted, enabling the resilience of the molded product to be enhanced.

The amount of component (d) included per 100 parts by weight of the resin component may be set to at least 0.1 part by weight, preferably at least 0.5 part by weight, and more preferably at least 1 part by weight. The upper limit may be set to not more than 17 parts by weight, preferably not more than 15 parts by weight, more preferably not more than 13 parts by weight, and even more preferably not more than 10 parts by weight. Including too little component (d) may fail to improve thermal stability and resilience, whereas including too much may instead lower the heat resistance of the golf ball material owing to the presence of excess basic inorganic metal compound.

As mentioned above, by including specific amounts of components (c) and (d) with respect to the resin component composed of a base resin of specific amounts of components (a) and (b) in admixture with optional component (e), a material of excellent thermal stability, flow properties and moldability can be obtained, and the resilience of the resulting molded product can be dramatically improved.

It is recommended that the material obtained by blending specific amounts of the above resin component and components (c) and (d) have a high degree of neutralization (i.e., that it be highly neutralized). Specifically, it is recommended that at least 50 mol %, preferably at least 60 mol %, more preferably at least 70 mol %, and even more preferably at least 80 mol %, of the acid groups in the material be neutralized. High neutralization of acid groups in the material makes it possible to more reliably suppress the exchange reactions that cause trouble when only a base resin and a fatty acid (or fatty acid derivative) are used as in the above-cited prior art, thus preventing the generation of fatty acid. As a result, the thermal stability is greatly improved and the moldability is good, enabling molded products to be obtained which have an excellent resilience compared with conventional ionomer resins.

Here, "degree of neutralization" refers to the degree of neutralization of acid groups present within the mixture of the base resin and the fatty acid (or fatty acid derivative) serving as component (c), and differs from the degree of neutralization of the ionomer resin itself in cases where an ionomer resin is used as the metal ion neutralization product of a random copolymer in the base resin. On comparing such a mixture having a certain degree of neutralization with an ionomer resin alone having the same degree of neutralization, the mixture of the invention, by including component (d), contains a very large number of metal ions and thus has a higher density of ionic crosslinks which contribute to improved resilience, making it possible to confer the molded product with an excellent resilience.

Optional additives may be suitably included in the highly neutralized resin material in accordance with the intended use. For example, various additives such as pigments, dispersants, antioxidants, ultraviolet absorbers and light stabilizers may be added. When such additives are included, the amount thereof, per 100 parts by weight of components (a) to (e) combined, is preferably at least 0.1 part by weight, and more preferably at least 0.5 part by weight, with the upper limit being preferably not more than 10 parts by weight, and more preferably not more than 4 parts by weight.

The inner envelope layer has a material hardness on the Shore D hardness scale of preferably at least 40, more preferably at least 42, and even more preferably at least 44. The upper limit is preferably not more than 52, more preferably not more than 50, and even more preferably not more than 48. The sphere obtained by encasing the core with the inner envelope layer (referred to below as the "inner envelope layer-encased sphere") has a surface hardness on the Shore hardness scale of preferably at least 46, more preferably at least 48, and even more preferably at least 50. The upper limit is preferably not more than 58, more preferably not more than 56, and even more preferably not more than 54. When the inner envelope layer-encased sphere is too soft, the ball may be too receptive to spin on full shots, as a result of which a good distance may not be achieved. On the other hand, when the inner envelope layer-encased sphere is too hard, the durability to cracking on repeated impact may worsen and the feel at impact may become too hard.

The inner envelope layer-encased sphere has an initial velocity of preferably at least 76.6 m/s, more preferably at least 76.8 m/s, and even more preferably at least 77.0 m/s. The upper limit is preferably not more than 77.7 m/s, more preferably not more than 77.5 m/s, and even more preferably not more than 77.3 m/s. When the initial velocity of this sphere exceeds the above range, the ball initial velocity may exceed the maximum value allowed under the Rules of Golf by the R&A and may therefore not be acceptable as an official ball. On the other hand, when the initial velocity of this sphere is smaller than the above range, the ball may be too receptive to spin on full shots, as a result of which a good distance may not be obtained. The initial velocity of the inner envelope layer-encased sphere is measured by the same method and under the same conditions as described above for the initial velocity of the core.

The inner envelope layer has a thickness which is preferably at least 0.5 mm, more preferably at least 0.7 mm, and even more preferably at least 0.9 mm. The upper limit is preferably not more than 1.6 mm, more preferably not more than 1.3 mm, and even more preferably not more than 1.1 mm. When the thickness of the inner envelope layer falls outside of the above range, the spin rate-lowering effect on shots with a W#1 may be inadequate, as a result of which a good distance may not be obtained.

The outer envelope layer has a material hardness on the Shore D hardness scale of preferably at least 45, more preferably at least 47, and even more preferably at least 49. The upper limit is preferably not more than 57, more preferably not more than 55, and even more preferably not more than 53. The sphere obtained by encasing the core with the inner envelope layer and the outer envelope layer (referred to below as the "outer envelope layer-encased sphere") has a surface hardness on the Shore hardness scale of preferably at least 51, more preferably at least 53, and even more preferably at least 55. The upper limit is preferably not more than 63, more preferably not more than 61, and even more preferably not more than 59. When the outer envelope layer-encased sphere is softer than this range, the ball may be too receptive to spin on full shots, as a result of which a good distance may not be achieved. On the other hand, when the outer envelope layer-encased sphere is too hard, the durability to cracking on repeated impact may worsen and the feel of the ball when hit with a putter or on short approaches may be too hard.

The outer envelope layer-encased sphere has an initial velocity of preferably at least 76.6 m/s, more preferably at least 76.8 m/s, and even more preferably at least 77.0 m/s. The upper limit is preferably not more than 77.7 m/s, more preferably not more than 77.5 m/s, and even more preferably not more than 77.3 m/s. When the initial velocity of this sphere exceeds the above range, the ball initial velocity may exceed the maximum value allowed under the Rules of Golf by the R&A and may therefore not be acceptable as an official ball. On the other hand, when the initial velocity of this sphere is smaller than the above range, the ball may be too receptive to spin on full shots, as a result of which a good distance may not be obtained. The initial velocity of the outer envelope layer-encased sphere is measured by the same method and under the same conditions as described above for the initial velocities of the core and the inner envelope layer-encased sphere.

The outer envelope layer has a thickness which is preferably at least 0.4 mm, more preferably at least 0.6 mm, and even more preferably at least 0.8 mm. The upper limit is preferably not more than 1.5 mm, more preferably not more than 1.2 mm, and even more preferably not more than 1.0 mm. When the thickness of the outer envelope layer falls outside of the above range, the ball may be too receptive to spin on shots with a W#1, as a result of which a good distance may not be obtained.

Next, the intermediate layer is described. The intermediate layer has a material hardness on the Shore D hardness scale which, although not particularly limited, is preferably at least 50, more preferably at least 52, and even more preferably at least 54. The upper limit is preferably not more than 60, more preferably not more than 58, and even more preferably not more than 56. The sphere obtained by encasing the core with the inner envelope layer, the outer envelope layer and the intermediate layer (referred to below as the "intermediate layer-encased sphere") has a surface hardness on the Shore hardness scale of preferably at least 56, more preferably at least 58, and even more preferably at least 60. The upper limit is preferably not more than 66, more preferably not more than 64, and even more preferably not more than 62. When the intermediate layer-encased sphere is softer than this range, the ball may be too receptive to spin on full shots, as a result of which a good distance may not be achieved. On the other hand, when the intermediate layer-encased sphere is harder than this range, the durability to cracking on repeated impact may worsen and the feel of the ball when hit with a putter or on short approaches may be too hard.

The intermediate layer-encased sphere has an initial velocity of preferably at least 76.8 m/s, more preferably at least 77.0 m/s, and even more preferably at least 77.2 m/s. The upper limit is preferably not more than 77.9 m/s, more preferably not more than 77.7 m/s, and even more preferably not more than 77.5 m/s. When the initial velocity of this sphere exceeds the above range, the ball initial velocity may exceed the maximum value allowed under the Rules of Golf by the R&A and may therefore not be acceptable as an official ball. On the other hand, when the initial velocity of this sphere is smaller than the above range, the ball may be too receptive to spin on full shots, as a result of which a good distance may not be obtained. The initial velocity of the intermediate layer-encased sphere is measured by the same method and under the same conditions as described above for the initial velocities of the core, the inner envelope layer-encased sphere and the outer envelope layer-encased sphere.

The intermediate layer has a thickness which, although not particularly limited, is preferably at least 0.4 mm, more preferably at least 0.6 mm, and even more preferably at least 0.8 mm. The upper limit is preferably not more than 1.5 mm, more preferably not more than 1.2 mm, and even more preferably not more than 1.0 mm. When the thickness of the intermediate layer falls outside of the above range, the ball may be too receptive to spin on shots with a W#1, as a result of which a good distance may not be obtained.

Next, the cover serving as the outermost layer is described. The cover (outermost layer) material is not particularly limited. Various types of thermoplastic resin materials may be used. In particular, from the standpoint of obtaining a good rebound, preferred use can be made of an ionomer resin. More preferably, when a high acid-content ionomer resin with an acid content of at least 16% is included as at least 50 wt % of the overall cover material, a high rebound and a good spin rate-lowering effect can be obtained, enabling a good distance to be achieved on shots with a driver (W#1).

The cover has a material hardness on the Shore D hardness scale which, although not particularly limited, is preferably at least 55, more preferably at least 58, and even more preferably at least 60. The upper limit is preferably not more than 70, more preferably not more than 67, and even more preferably not more than 65. The sphere obtained by encasing the core with the inner envelope layer, the outer envelope layer, the intermediate layer and the cover, i.e., the ball, has a surface hardness on the Shore hardness scale of preferably at least 61, more preferably at least 64, and even more preferably at least 66. The upper limit is preferably not more than 76, more preferably not more than 73, and even more preferably not more than 71. When the surface hardness of the ball is lower than this range, the spin rate on shots with a W#1 may become too high, as a result of which a good distance may not be achieved. On the other hand, when the ball surface hardness is higher that this range, the feel at impact may become too hard and the durability to cracking on repeated impact may worsen.

The cover has a thickness which, although not particularly limited, is preferably at least 0.5 mm, more preferably at least 1.0 mm, and even more preferably at least 1.2 mm. The upper limit is preferably not more than 2.0 mm, more preferably not more than 1.5 mm, and even more preferably not more than 1.4 mm. When the cover is thicker than the above range, the spin rate may increase, as a result of which a good distance may not be obtained. When the cover is thinner than the above range, the spin rate may increase, as a result of which a good distance may not be obtained, or the durability to cracking on repeated impact may worsen.

The ball has an initial velocity of preferably at least 76.5 m/s, more preferably at least 76.8 m/s, and even more preferably at least 77.0 m/s. The upper limit is preferably not more than 77.7 m/s. When the ball initial velocity is higher than the above range, it exceeds the maximum value allowed under the Rules of Golf by the R&A and so the ball may not be acceptable as an official ball. On the other hand, when the ball initial velocity is smaller than the above range, a good distance may not be obtained. The initial velocity of the ball is measured by the same method and under the same conditions as described above for the initial velocities of the core and the various layer-encased spheres.

The ball deflection under specific loading conditions, i.e., the ball deflection (mm) when compressed under a final load of 1.275 N (130 kgf) from an initial load of 98 N (10 kgf), although not particularly limited, is preferably at least 2.6 mm, more preferably at least 2.9 mm, and even more preferably at least 3.2 mm. The upper limit is preferably not more than 4.4 mm, more preferably not more than 4.1 mm, and even more preferably not more than 3.8 mm. When this value is too large, the feel of the ball on shots with a W#1 may become too soft or the durability to cracking on repeated impact may worsen. On the other hand, when this value is too small, the spin rate on shots with a W#1 may become too high, as a result of which the intended distance may not be obtained.

The manufacture of multi-piece solid golf balls in which the above-described core, inner envelope layer, outer envelope layer, intermediate layer and cover (outermost layer) are formed as successive layers may be carried out by a customary method such as a known injection-molding process. For example, a multi-piece golf ball may be obtained by successively injection-molding an inner envelope layer material, an outer envelope layer material and an intermediate layer material over a molded and vulcanized product composed primarily of a rubber material as the core so as to obtain the respective layer-encased spheres and then, last of all, injection-molding a cover (outermost layer) material. Alternatively, the respective encasing layers may each be formed by enclosing the sphere to be encased within two half-cups that have been pre-molded into hemispherical shapes and then molding under applied heat and pressure.

It is essential for the golf ball to satisfy the following condition:

cover thickness>envelope layer inside thickness, envelope layer outside thickness, and intermediate layer thickness, respectively.

That is, the cover must have a greater thickness than the thicknesses of each of the following layers: the inner envelope layer, the outer envelope layer, and the intermediate layer. By establishing this thickness relationship, the spin rate of the ball on shots with a W#1 is kept from becoming too high, enabling a good distance to be obtained.

In this invention, the value (A)−(B) obtained by subtracting the material hardness (B) of the softest layer among the inner envelope layer, the outer envelope layer and the intermediate layer from the material hardness (A) of the cover is a Shore D hardness of 13 or more. This Shore D hardness value is preferably at least 14, and more preferably at least 15. The upper limit is preferably not more than 30, and more preferably not more than 20. When this value is too low, the ball initial velocity may be low, as a result of which the ball may not achieve a good distance. On the other hand, when this value is too high, the spin rate may rise, as a result of which the ball may not achieve a good distance.

It is advantageous for the golf ball of the invention to satisfy the following conditions. With regard to the thicknesses of the respective layers, it is preferable for the cover thickness>the intermediate layer thickness<the core diameter; it is more preferable for the cover thickness>the intermediate layer thickness≤the envelope layer outside thickness≤the envelope layer inside thickness≤the core diameter; and it is even more preferable for the cover thickness>the intermediate layer thickness<the envelope layer outside thickness<the envelope layer inside thickness<the core diameter. By establishing this thickness relationship, the spin rate of the ball on shots with a W#1 is kept from becoming too high, enabling the ball to achieve a good distance.

With regard to the relationship between the thicknesses of the cover and the inner envelope layer, the (cover thickness)/(inner envelope layer thickness) value is preferably at least 1.1, and more preferably at least 1.2; the upper limit is preferably not more than 1.9, and more preferably not more than 1.8. With regard to the relationship between the thicknesses of the cover and the outer envelope layer, the (cover thickness)/(outer envelope layer thickness) value is preferably at least 1.1, and more preferably at least 1.2; the upper limit is preferably not more than 1.9, and more preferably not more than 1.8.

The value obtained by subtracting the surface hardness of the intermediate layer-encased sphere from the surface hardness of the ball, expressed in terms of the Shore D hardness, is preferably from 0 to 15, more preferably from 3 to 12, and even more preferably from 6 to 10. By thus specifying the relationship between the surface hardness of the ball and the surface hardness of the intermediate layer-encased sphere, the spin rate of the ball on shots with a W#1 can be kept from becoming too high, enabling the ball to achieve a good distance.

The value obtained by subtracting the surface hardness of the outer envelope layer-encased sphere from the surface hardness of the intermediate layer-encased sphere, expressed in terms of the Shore D hardness, is preferably from 0 to 10, more preferably from 1 to 8, and even more preferably from 2 to 6. Also, the value obtained by subtracting the surface hardness of the inner envelope layer-encased sphere from the surface hardness of the outer envelope layer-encased sphere is preferably from 0 to 10, more preferably from 1 to 8, and even more preferably from 2 to 6. By thus specifying the relationships between the surface hardness of the inner envelope-encased sphere, the surface hardness of the outer envelope-encased sphere and the surface hardness of the intermediate layer-encased sphere, the spin rate of the ball on shots with a W#1 can be kept from becoming too high, enabling the ball to achieve a good distance.

In addition, the value obtained by subtracting the core surface hardness from the surface hardness of the inner envelope layer-encased sphere, expressed in terms of the Shore D hardness, is preferably from 0 to 10, more preferably from 1 to 8, and even more preferably from 2 to 6. By setting this value in the above range, the spin rate of the ball on shots with a W#1 can be kept from becoming too high, enabling the ball to achieve a good distance.

The total thickness of the layers encasing the core, i.e., the (cover thickness+intermediate layer thickness+outer envelope layer thickness+inner envelope layer thickness) value is preferably at least 3.0 mm, more preferably at least 3.3 mm, and even more preferably at least 3.5 mm. The upper limit is preferably not more than 5.0 mm, more preferably not more than 4.7 mm, and even more preferably not more than 4.5 mm. By setting this value in the above range, the spin rate of the ball on shots with a W#1 can be kept from becoming too high, enabling the ball to achieve a good distance.

The material hardnesses of the respective layers and the center hardness of the core preferably satisfy the following condition:

cover material hardness>intermediate layer material hardness>outer envelope layer material hardness>inner envelope layer material hardness>core center hardness.

By satisfying this condition, the spin rate of the ball on shots with a W#1 can be kept from becoming too high, enabling the ball to achieve a good distance.

Moreover, in the relationships among the initial velocities of the core, the sphere (I) consisting of the core encased by the inner envelope layer, the sphere (II) consisting of sphere (I) encased by the outer envelope layer, the sphere (III) consisting of sphere (II) encased by the intermediate layer, and the ball, it is preferable for the following conditions to be satisfied:

ball initial velocity Sphere (*III*) initial velocity>Sphere (*II*) initial velocity≥Sphere (*I*) initial velocity; and ball initial velocity>core initial velocity.

By satisfying the above conditions, the spin rate of the ball on shots with a W#1 can be kept from becoming too high, enabling the ball to achieve a good distance.

Numerous dimples may be formed on the outer surface of the cover (outermost layer). The number of dimples arranged on the cover surface, although not particularly limited, may be set to preferably at least 280, more preferably at least 300, and even more preferably at least 320, with the upper limit being preferably not more than 360, more preferably not more than 350, and even more preferably not more than 340. When the number of dimples is higher than this range, the ball trajectory may become low, as a result of which the distance traveled by the ball may decrease. On the other hand, when the number of dimples is lower than this range, the ball trajectory may become high, as a result of which a good distance may not be achieved.

The golf ball of the invention can be made to conform to the Rules of Golf for play. Specifically, the inventive ball may be formed to a diameter which is such that the ball does not pass through a ring having an inner diameter of 42.672 mm and is not more than 42.80 mm, and to a weight which is preferably from 45.0 to 45.93 g.

EXAMPLES

The following Examples and Comparative Examples are provided to illustrate the invention, and are not intended to limit the scope thereof.

Examples 1 to 4, Comparative Examples 1 to 8

Cores were produced by preparing the core compositions formulated as shown in Table 1 below, then molding and vulcanizing the compositions under vulcanization conditions of 155° C. and 15 minutes.

TABLE 1

| Core formulation | Working Example | | | | Comparative Example | | | | | | | |
|---|---|---|---|---|---|---|---|---|---|---|---|---|
| (pbw) | 1 | 2 | 3 | 4 | 1 | 2 | 3 | 4 | 5 | 6 | 7 | 8 |
| Polybutadiene A | 80 | 80 | 80 | 80 | 80 | 80 | 80 | 80 | 80 | 80 | 80 | 80 |
| Polybutadiene B | 20 | 20 | 20 | 20 | 20 | 20 | 20 | 20 | 20 | 20 | 20 | 20 |
| Zinc acrylate | 28.5 | 27.5 | 26.5 | 26.5 | 28.5 | 28.5 | 28.5 | 28.5 | 28.5 | 28.5 | 28.5 | 28.5 |
| Organic peroxide | 1.0 | 1.0 | 1.0 | 1.0 | 1.0 | 1.0 | 1.0 | 1.0 | 1.0 | 1.0 | 1.0 | 1.0 |
| Water | 0.4 | 0.4 | 0.4 | 0.4 | 0.4 | 0.4 | 0.4 | 0.4 | 0.4 | 0.4 | 0.4 | 0.4 |
| Antioxidant | 0.1 | 0.1 | 0.1 | 0.1 | 0.1 | 0.1 | 0.1 | 0.1 | 0.1 | 0.1 | 0.1 | 0.1 |
| Barium sulfate | 33.0 | 33.3 | 33.7 | 33.7 | 33.0 | 33.0 | 30.9 | 33.0 | 33.0 | 33.0 | 29.7 | 30.9 |
| Zinc oxide | 4.0 | 4.0 | 4.0 | 4.0 | 4.0 | 4.0 | 4.0 | 4.0 | 4.0 | 4.0 | 4.0 | 4.0 |
| Zinc salt of pentachlorothiophenol | 0.5 | 0.5 | 0.5 | 0.5 | 0.5 | 0.5 | 0.5 | 0.5 | 0.5 | 0.5 | 0.5 | 0.5 |

Details on the above core materials are given below. Numbers in the table indicate parts by weight.

Polybutadiene A: Available under the trade name "BR 01" from JSR Corporation

Polybutadiene B: Available under the trade name "BR 51" from JSR Corporation

Organic peroxide: Dicumyl peroxide, available under the trade name "Percumyl D" from NOF Corporation Water: Distilled water, available from Wako Pure Chemical Industries, Ltd.

Antioxidant: 2,2'-Methylenebis(4-methyl-6-t-butylphenol), available under the trade name "Nocrac NS-6" from Ouchi Shinko Chemical Industry Co., Ltd.

Barium sulfate: Available under the trade name "Barico #300" from Hakusui Tech

Zinc oxide: Available as "Zinc Oxide Grade 3" from Sakai Chemical Co., Ltd.

Properties such as the diameter, hardness profile, initial velocity and deflection of the cores obtained above were measured as follows.

Core Diameter

The diameters at five random places on a core were measured at a temperature of 23.9±1° C. and, treating the average of these measurements as the measured value for a single core, the average diameter for ten measured specimens was determined.

Core Hardness Profile

The indenter of a durometer was set so as to be substantially perpendicular to the spherical surface of the core, and the core surface hardness on the JIS-C hardness scale was measured as specified in JIS K6301-1975.

To obtain the hardnesses at the center and other specific cross-sectional positions of the core, the core was hemispherically cut so as form a planar cross-section, and measurements were carried out by pressing the indenter of a durometer perpendicularly against the cross-section at the measurement positions. The results are indicated as JIS-C hardness values.

The Shore D hardness at the core surface was measured with a type D durometer in accordance with ASTM D2240-95.

Initial Velocity of Core

The initial velocity of the core was measured using an initial velocity measuring apparatus of the same type as the USGA drum rotation-type initial velocity instrument approved by the R&A. The core was held isothermally in a 23.9±1° C. environment for at least 3 hours, and then tested in a room temperature (23.9±2° C.) chamber. The core was struck using a 250-pound (113.4 kg) head (striking mass) at an impact velocity of 143.8 ft/s (43.83 m/s). One dozen cores were each struck four times. The time taken for the core to traverse a distance of 6.28 ft (1.91 m) was measured and used to compute the initial velocity (m/s). This cycle was carried out over a period of about 15 minutes.

Core Deflection

The amount of deflection by a core when placed on a hard plate and compressed under a final load of 1,275 N (130 kgf) from an initial load of 98 N (10 kgf) was measured. The amount of deflection here refers in each case to the measured value obtained after holding the core isothermally at 23.9° C.

TABLE 2

| | | Working Example | | | | Comparative Example | | | | | | | |
|---|---|---|---|---|---|---|---|---|---|---|---|---|---|
| | | 1 | 2 | 3 | 4 | 1 | 2 | 3 | 4 | 5 | 6 | 7 | 8 |
| | Diameter (mm) | 34.8 | 34.8 | 34.8 | 34.8 | 34.8 | 34.8 | 34.8 | 34.8 | 34.8 | 34.8 | 35.5 | 35.5 |
| | Weight (g) | 27.6 | 27.6 | 27.6 | 27.6 | 27.6 | 27.6 | 27.4 | 27.6 | 27.6 | 27.6 | 28.9 | 29.1 |
| | Deflection (mm) | 4.4 | 4.6 | 4.8 | 4.8 | 4.4 | 4.4 | 4.4 | 4.4 | 4.4 | 4.4 | 4.4 | 4.4 |
| Hardness profile (JIS-C) | Surface hardness (Cs) | 76 | 74 | 73 | 73 | 76 | 76 | 76 | 76 | 76 | 76 | 76 | 76 |
| | Hardness at position 15 mm from center (C15) | 71 | 71 | 70 | 70 | 71 | 71 | 71 | 71 | 71 | 71 | 71 | 71 |
| | Hardness at position 10 mm from center (C10) | 62 | 61 | 61 | 61 | 62 | 62 | 62 | 62 | 62 | 62 | 62 | 62 |
| | Hardness at position 5 mm from center (C5) | 59 | 58 | 57 | 57 | 59 | 59 | 59 | 59 | 59 | 59 | 59 | 59 |
| | Center hardness (Cc) | 57 | 55 | 54 | 54 | 57 | 57 | 57 | 57 | 57 | 57 | 57 | 57 |
| | Cs − C15 | 5 | 4 | 3 | 3 | 5 | 5 | 5 | 5 | 5 | 5 | 5 | 5 |
| | C15 − C10 | 10 | 9 | 9 | 9 | 10 | 10 | 10 | 10 | 10 | 10 | 10 | 10 |
| | C10 − C5 | 3 | 3 | 4 | 4 | 3 | 3 | 3 | 3 | 3 | 3 | 3 | 3 |
| | C5 − Cc | 2 | 3 | 3 | 3 | 2 | 2 | 2 | 2 | 2 | 2 | 2 | 2 |
| | Surface − Center (Cs − Cc) | 19 | 19 | 19 | 19 | 19 | 19 | 19 | 19 | 19 | 19 | 19 | 19 |
| | C10 − Cc | 5 | 6 | 7 | 7 | 5 | 5 | 5 | 5 | 5 | 5 | 5 | 5 |
| | Cs − C10 | 14 | 13 | 12 | 12 | 14 | 14 | 14 | 14 | 14 | 14 | 14 | 14 |
| | (Cs − C10)/(C10 − Cc) | 2.8 | 2.2 | 1.7 | 1.7 | 2.8 | 2.8 | 2.8 | 2.8 | 2.8 | 2.8 | 2.8 | 2.8 |
| | Surface hardness (Shore D) | 50 | 48 | 47 | 47 | 50 | 50 | 50 | 50 | 50 | 50 | 50 | 50 |
| | Center hardness (Shore D) | 35 | 34 | 33 | 33 | 35 | 35 | 35 | 35 | 35 | 35 | 35 | 35 |
| | Initial velocity (m/s) | 77.4 | 77.3 | 77.3 | 77.3 | 77.4 | 77.4 | 77.4 | 77.4 | 77.4 | 77.4 | 77.4 | 77.4 |

Formation of Envelope Layers, Intermediate Layer and Cover

Next, using the resin materials (No. 1 to No. 10) formulated as shown in Table 3 below, an inner envelope layer, an outer envelope layer, an intermediate layer and a cover (outermost layer) were successively injection-molded over the core obtained above, thereby producing multi-piece solid golf balls in the respective Examples.

Figure 2:
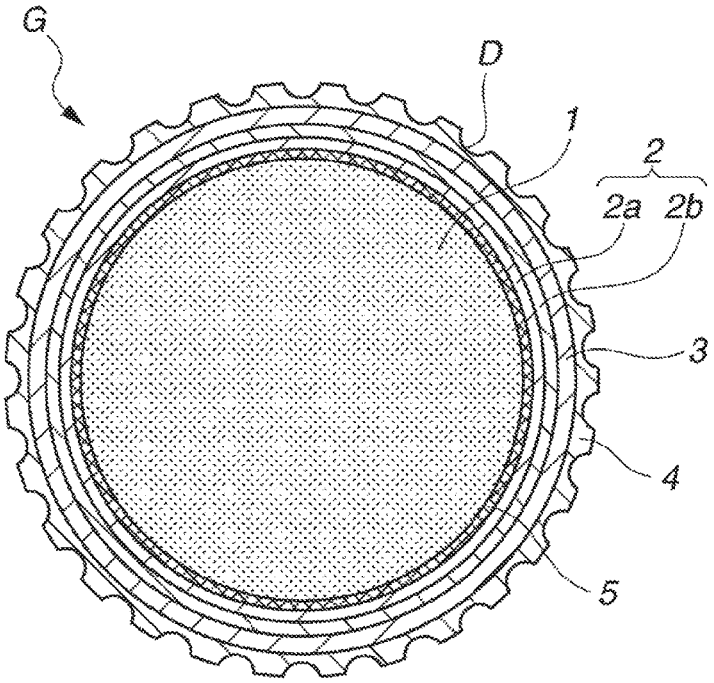
FIG. 2 is a schematic cross-sectional view of the six-piece golf ball used in one of the Comparative Examples.

The ball in Comparative Example 1 has a four-piece construction without an inner envelope layer. The ball in Comparative Example 2 has a three-piece construction without an inner envelope layer and without an outer envelope layer. The ball in Comparative Example 3 has a two-piece construction without an inner envelope layer, an outer envelope layer and an intermediate layer. Referring to FIG. 2, the ball in Comparative Example 8 has a six-piece construction in which an additional layer (denoted in the diagram by the reference number 5) is provided between the core and the inner envelope layer.

TABLE 3

| Resin material (pbw) | No. 1 | No. 2 | No. 3 | No. 4 | No. 5 | No. 6 | No. 7 | No. 8 | No. 9 | No. 10 |
|---|---|---|---|---|---|---|---|---|---|---|
| HPF2000 | 100 | | | | | | | | | |
| Himilan 1706 (acid content, 15 wt %) | | | | 50 | | | | | | |
| Himilan 1557 (acid content, 12 wt %) | | | | | 50 | | | | | 50 |
| Himilan 1855 | | | | | | 50 | | | | |
| Himilan 1605 (acid content, 15 wt %) | | | | 50 | | | | | | |
| Himilan 1601 (acid content, 10 wt %) | | | | | | | | | | 50 |
| Himilan 1856 | | | | | 50 | | | | | |
| Surlyn 8120 | | | | | | 50 | 50 | | | |
| Surlyn 9320 | | 70 | | | | | | | | |
| AM7318 (acid content, 18 wt %) | | | | | | | | 75 | | |
| AM7327 (acid content, 10 wt %) | | | | | | | 50 | 25 | | |
| AN4319 (acid content, 17 wt %) | | | 20 | | | | | | 100 | |
| AN4221C | | 30 | 80 | | | | | | | |
| Titanium oxide | | | | 5 | | | | 5 | | 5 |
| Magnesium stearate | | 60 | 60 | | | | | | 100 | |
| Calcium hydroxide | | | 1.5 | | | | | | | |
| Magnesium oxide | | 1.12 | 1 | | | | | | 2.8 | |

Trade names for the materials shown in the table are as follows.

HPF2000: HPF® 2000, available from E.I. DuPont de Nemours & Co.

Himilan: Ionomers available from DuPont-Mitsui Polychemicals Co., Ltd.

Surlyn: Ionomers available from E.I. DuPont de Nemours & Co.

AM7318, AM7327: Ionomers available from DuPont-Mitsui Polychemicals Co., Ltd.

AN4319, AN4221C: An unneutralized ethylene-methacrylic acid-acrylic acid ester terpolymer and an unneutralized ethylene-acrylic acid copolymer (Nucrel®, from DuPont-Mitsui Polychemicals Co., Ltd.)

Titanium oxide: "R-550" from Ishihara Sangyo Kaisha, Ltd.

Magnesium stearate: "Magnesium Stearate G" from NOF Corporation

Calcium hydroxide: "Calcium Hydroxide CLS-B" from Shiraishi Calcium Kaisha, Ltd.

Magnesium oxide: "Kyowamag MF 150" from Kyowa Chemical Industry Co., Ltd.

Although not shown in the diagrams, a common dimple pattern was formed on the surface of the ball cover in each Working Example and Comparative Example.

For each of the resulting golf balls, properties such as the thicknesses and material hardnesses of each layer encasing the core and the surface hardnesses of the various layer-encased spheres were evaluated by the methods described below. The results are shown in Table 4 (Working Examples 1 to 4, Comparative Examples 1 and 2) and Table 5 (Comparative Examples 3 to 8).

Diameter of Inner Envelope Layer-Encased Sphere, Outer Envelope Layer-Encased Sphere and Intermediate Layer-Encased Sphere The diameters at five random places on the surface were measured at a temperature of 23.9±1° C. and, using the average of these measurements as the measured value for a single inner envelope layer-encased sphere, outer envelope layer-encased sphere or intermediate layer-encased sphere, the average diameter for ten specimens of each type of sphere was determined.

Ball Diameter

The diameters at 15 random dimple-free areas on the surface of a ball were measured at a temperature of 23.9±1° C. and, using the average of these measurements as the measured value for a single ball, the average diameter for ten measured balls was determined.

Material Hardnesses of Inner Envelope Layer, Outer Envelope Layer, Intermediate Layer and Cover The inner envelope layer, outer envelope layer, intermediate layer and cover-forming resin materials were molded into sheets having a thickness of 2 mm and left to stand for at least two weeks, following which the Shore D hardnesses were measured in accordance with ASTM D2240-95.

Surface Hardnesses of Various Layer-Encased Spheres and Ball (Shore D Hardnesses)

Measurements were taken by pressing the durometer indenter perpendicularly against the surface of the layer-encased sphere or ball (i.e., the surface of the cover). The surface hardness of the ball (cover) is the measured value obtained at dimple-free places (lands) on the ball surface. The Shore D hardnesses were measured with a type D durometer in accordance with ASTM D2240-95.

Initial Velocities of Various Layer-Encased Spheres and Ball

The initial velocities were measured using an initial velocity measuring apparatus of the same type as the USGA drum rotation-type initial velocity instrument approved by the R&A. The various layer-encased spheres and balls (referred to below as "spherical test specimens") were held isothermally in a 23.9±1° C. environment for at least 3 hours, and then tested in a room temperature (23.9±2° C.) chamber. Each spherical test specimen was hit using a 250-pound (113.4 kg) head (striking mass) at an impact velocity of 143.8 ft/s (43.83 m/s). One dozen spherical test specimens were each hit four times. The time taken for the test specimen to traverse a distance of 6.28 ft (1.91 m) was measured and used to compute the initial velocity (m/s). This cycle was carried out over a period of about 15 minutes.

TABLE 4

| | | Working Example | | | | Comparative Example | |
|---|---|---|---|---|---|---|---|
| | | 1 | 2 | 3 | 4 | 1 | 2 |
| Construction | | 5-piece | 5-piece | 5-piece | 5-piece | 4-piece | 3-piece |
| Layer between core and inner envelope layer | Type of material | — | — | — | — | — | — |
| | Thickness (mm) | — | — | — | — | — | — |
| | Specific gravity | — | — | — | — | — | — |
| | Material hardness (Shore D) | — | — | — | — | — | — |
| Sphere encased by layer between core and inner envelope layer | Diameter (mm) | — | — | — | — | — | — |
| | Weight (g) | — | — | — | — | — | — |
| | Surface hardness (Shore D) | — | — | — | — | — | — |
| | Initial velocity (m/s) | — | — | — | — | — | — |
| Inner envelope layer | Type of material | No. 1 | No. 1 | No. 1 | No. 1 | — | — |
| | Thickness (mm) | 1.0 | 1.0 | 1.0 | 1.0 | — | — |
| | Specific gravity | 0.96 | 0.96 | 0.96 | 0.96 | — | — |
| | Material hardness (Shore D) | 46 | 46 | 46 | 46 | — | — |
| Sphere encased by inner envelope layer | Diameter (mm) | 36.8 | 36.8 | 36.8 | 36.8 | — | — |
| | Weight (g) | 31.5 | 31.5 | 31.5 | 31.5 | — | — |
| | Surface hardness (Shore D) | 52 | 52 | 52 | 52 | — | — |
| | Initial velocity (m/s) | 77.2 | 77.1 | 77.1 | 77.1 | — | — |
| Outer envelope layer | Type of material | No. 2 | No. 2 | No. 2 | No. 2 | No. 1 | — |
| | Thickness (mm) | 0.9 | 0.9 | 0.9 | 0.9 | 1.9 | — |
| | Specific gravity | 0.96 | 0.96 | 0.96 | 0.96 | 0.96 | — |
| | Material hardness (Shore D) | 51 | 51 | 51 | 51 | 46 | — |
| Sphere encased by outer envelope layer | Diameter (mm) | 38.6 | 38.6 | 38.6 | 38.6 | 38.6 | — |
| | Weight (g) | 35.3 | 35.3 | 35.3 | 35.3 | 35.3 | — |
| | Surface hardness (Shore D) | 57 | 57 | 57 | 57 | 52 | — |
| | Initial velocity (m/s) | 77.2 | 77.1 | 77.1 | 77.1 | 77.1 | — |
| Intermediate layer | Type of material | No. 3 | No. 3 | No. 3 | No. 3 | No. 3 | No. 2 |
| | Thickness (mm) | 0.8 | 0.8 | 0.8 | 0.8 | 0.8 | 2.7 |
| | Specific gravity | 0.96 | 0.96 | 0.96 | 0.96 | 0.96 | 0.96 |
| | Material hardness (Shore D) | 55 | 55 | 55 | 55 | 55 | 51 |
| Sphere encased by intermediate layer | Diameter (mm) | 40.2 | 40.2 | 40.2 | 40.2 | 40.2 | 40.2 |
| | Weight (g) | 39.1 | 39.1 | 39.1 | 39.1 | 39.1 | 39.1 |
| | Surface hardness (Shore D) | 61 | 61 | 61 | 61 | 61 | 61 |
| | Initial velocity (m/s) | 77.4 | 77.3 | 77.3 | 77.3 | 77.3 | 77.4 |
| Surface hardness of inner envelope layer - Surface hardness of core (Shore D) | | 2 | 4 | 5 | 5 | — | — |
| Surface hardness of outer envelope layer - Surface hardness of inner envelope layer (Shore D) | | 5 | 5 | 5 | 5 | — | — |
| Surface hardness of intermediate layer - Surface hardness of outer envelope layer (Shore D) | | 4 | 4 | 4 | 4 | 9 | — |
| Cover | Type of material | No. 4 | No. 4 | No. 4 | No. 8 | No. 4 | No. 4 |
| | Thickness (mm) | 1.25 | 1.25 | 1.25 | 1.25 | 1.25 | 1.25 |
| | Specific gravity | 0.98 | 0.98 | 0.98 | 0.98 | 0.98 | 0.98 |
| | Material hardness (Shore D) | 63 | 63 | 63 | 63 | 63 | 63 |
| Ball | Diameter (mm) | 42.7 | 42.7 | 42.7 | 42.7 | 42.7 | 42.7 |
| | Weight (g) | 45.5 | 45.5 | 45.5 | 45.5 | 45.5 | 45.5 |
| | Surface hardness (Shore D) | 69 | 69 | 69 | 69 | 69 | 69 |
| | Initial velocity (m/s) | 77.6 | 77.5 | 77.5 | 77.5 | 77.5 | 77.6 |
| Ball surface hardness - Intermediate layer surface hardness (Shore D) | | 8 | 8 | 8 | 8 | 8 | 8 |
| Total thickness of core - encasing layers (mm) | | 3.95 | 3.95 | 3.95 | 3.95 | 3.95 | 3.95 |
| Cover thickness - Intermediate layer thickness (mm) | | 0.45 | 0.45 | 0.45 | 0.45 | 0.45 | −1.45 |
| Cover thickness - Outer envelope layer thickness (mm) | | 0.35 | 0.35 | 0.35 | 0.35 | −0.65 | — |
| Cover thickness - Inner envelope layer thickness (mm) | | 0.25 | 0.25 | 0.25 | 0.25 | — | — |
| Cover thickness - Thickness of layer between core and inner envelope layer (mm) | | — | — | — | — | — | — |
| Cover material hardness - Intermediate layer material hardness (Shore D) | | 8 | 8 | 8 | 8 | 8 | 12 |
| Cover material hardness - Outer envelope layer material hardness (Shore D) | | 12 | 12 | 12 | 12 | 17 | — |
| Cover material hardness - Inner envelope layer material hardness (Shore D) | | 17 | 17 | 17 | 17 | — | — |
| Cover material hardness - Material hardness of layer between core and inner envelope layer (Shore D) | | — | — | — | — | — | — |

TABLE 5

| | | Comparative Example | | | | | |
|---|---|---|---|---|---|---|---|
| | | 3 | 4 | 5 | 6 | 7 | 8 |
| Construction | | 2-piece | 5-piece | 5-piece | 5-piece | 5-piece | 6-piece |
| Layer between core and inner envelope layer | Type of material | — | — | — | — | — | No. 1 |
| | Thickness (mm) | — | — | — | — | — | 0.6 |
| | Specific gravity | — | — | — | — | — | 0.96 |
| | Material hardness (Shore D) | — | — | — | — | — | 46 |
| Sphere encased by layer between core and inner envelope layer | Diameter (mm) | — | — | — | — | — | 36.7 |
| | Weight (g) | — | — | — | — | — | 31.4 |
| | Surface hardness (Shore D) | — | — | — | — | — | 52 |
| | Initial velocity (m/s) | — | — | — | — | — | 77.2 |

TABLE 5-continued

| | | Comparative Example | | | | | |
|---|---|---|---|---|---|---|---|
| | | 3 | 4 | 5 | 6 | 7 | 8 |
| Inner envelope layer | Type of material | — | No. 1 | No. 1 | No. 7 | No. 9 | No. 9 |
| | Thickness (mm) | — | 1.0 | 1.0 | 1.0 | 1.2 | 0.6 |
| | Specific gravity | — | 0.96 | 0.96 | 0.96 | 0.96 | 0.96 |
| | Material hardness (Shore D) | — | 46 | 46 | 46 | 48 | 48 |
| Sphere encased by inner envelope layer | Diameter (mm) | — | 36.8 | 36.8 | 36.8 | 37.9 | 37.9 |
| | Weight (g) | — | 31.5 | 31.5 | 31.5 | 33.8 | 33.8 |
| | Surface hardness (Shore D) | — | 52 | 52 | 52 | 54 | 54 |
| | Initial velocity (m/s) | — | 77.2 | 77.2 | 76.9 | 77.3 | 77.1 |
| Outer envelope layer | Type of material | — | No. 2 | No. 6 | No. 6 | No. 2 | No. 2 |
| | Thickness (mm) | — | 0.9 | 0.9 | 0.9 | 0.6 | 0.6 |
| | Specific gravity | — | 0.96 | 0.96 | 0.96 | 0.96 | 0.96 |
| | Material hardness (Shore D) | — | 51 | 51 | 51 | 51 | 51 |
| Sphere encased by outer envelope layer | Diameter (mm) | — | 38.6 | 38.6 | 38.6 | 39.1 | 39.1 |
| | Weight (g) | — | 35.3 | 35.3 | 35.3 | 36.5 | 36.5 |
| | Surface hardness (Shore D) | — | 57 | 57 | 57 | 57 | 57 |
| | Initial velocity (m/s) | — | 77.2 | 76.9 | 76.6 | 77.3 | 77.1 |
| Intermediate layer | Type of material | — | No. 5 | No. 5 | No. 5 | No. 3 | No. 3 |
| | Thickness (mm) | — | 0.8 | 0.8 | 0.8 | 0.6 | 0.6 |
| | Specific gravity | — | 0.96 | 0.96 | 0.96 | 0.96 | 0.96 |
| | Material hardness (Shore D) | — | 55 | 55 | 55 | 55 | 55 |
| Sphere encased by intermediate layer | Diameter (mm) | — | 40.2 | 40.2 | 40.2 | 40.3 | 40.3 |
| | Weight (g) | — | 39.1 | 39.1 | 39.1 | 39.3 | 39.3 |
| | Surface hardness (Shore D) | — | 61 | 61 | 61 | 61 | 61 |
| | Initial velocity (m/s) | — | 76.8 | 76.5 | 76.2 | 77.5 | 77.3 |
| Surface hardness of inner envelope layer - Surface hardness of core (Shore D) | | — | 2 | 2 | 2 | 4 | 4 |
| Surface hardness of outer envelope layer - Surface hardness of inner envelope layer (Shore D) | | — | 5 | 5 | 5 | 3 | 3 |
| Surface hardness of intermediate layer - Surface hardness of outer envelope layer (Shore D) | | — | 4 | 4 | 4 | 4 | 4 |
| Cover | Type of material | No. 4 | No. 4 | No. 4 | No. 4 | No. 10 | No. 10 |
| | Thickness (mm) | 3.95 | 1.25 | 1.25 | 1.25 | 1.2 | 1.2 |
| | Specific gravity | 0.98 | 0.98 | 0.98 | 0.98 | 0.98 | 0.98 |
| | Material hardness (Shore D) | 63 | 63 | 63 | 63 | 60 | 60 |
| Ball | Diameter (mm) | 42.7 | 42.7 | 42.7 | 42.7 | 42.7 | 42.7 |
| | Weight (g) | 45.5 | 45.5 | 45.5 | 45.5 | 45.5 | 45.5 |
| | Surface hardness (Shore D) | 69 | 69 | 69 | 69 | 66 | 69 |
| | Initial velocity (m/s) | 77.7 | 77.0 | 76.7 | 76.4 | 77.2 | 77.0 |
| Ball surface hardness - Intermediate layer surface hardness (Shore D) | | — | 8 | 8 | 8 | 5 | 8 |
| Total thickness of core - encasing layers (mm) | | 3.95 | 3.95 | 3.95 | 3.95 | 3.60 | 3.60 |
| Cover thickness - Intermediate layer thickness (mm) | | — | 0.45 | 0.45 | 0.45 | 0.6 | 0.6 |
| Cover thickness - Outer envelope layer thickness (mm) | | — | 0.35 | 0.35 | 0.35 | 0.6 | 0.6 |
| Cover thickness - Inner envelope layer thickness (mm) | | — | 0.25 | 0.25 | 0.25 | 0 | 0.6 |
| Cover thickness - Thickness of layer between core and inner envelope layer (mm) | | — | — | — | — | — | 0.6 |
| Cover material hardness - Intermediate layer material hardness (Shore D) | | — | 8 | 8 | 8 | 5 | 5 |
| Cover material hardness - Outer envelope layer material hardness (Shore D) | | — | 12 | 12 | 12 | 9 | 9 |
| Cover material hardness - Inner envelope layer material hardness (Shore D) | | — | 17 | 17 | 17 | 12 | 12 |
| Cover material hardness - Material hardness of layer between core and inner envelope layer (Shore D) | | — | — | — | — | — | 14 |

In addition, the flight performance (W#1) and feel of the golf balls obtained in the respective Working Examples and Comparative Examples were evaluated according to the criteria indicated below. The results are shown in Table 6.

Flight Performance (W#1 Shots)

A W#1 club (driver) was mounted on a golf swing robot, and the distance traveled by the ball when struck at a head speed (HS) of 35 m/s was measured and rated according to the criteria shown below. The club was a PHYZ III driver (2015 model; loft angle, 11.5°) manufactured by Bridgestone Sports Co., Ltd. In addition, using an apparatus for measuring the initial conditions, the spin rate was measured immediately after the ball was similarly struck.

Rating Criteria:

Good: Total distance was 177.0 m or more

NG: Total distance was less than 177.0 m

Feel

Sensory evaluations were carried out when the balls were hit with a driver (W#1) by amateur golfers having head speeds between 30 and 40 m/s. The feel of the ball was rated according to the following criteria.

Rating Criteria:

Good: Six or more out of ten golfers rated the feel as good

NG: Five or fewer out of ten golfers rated the feel as good

Here, a "good feel" refers to a feel at impact that is appropriately soft and yet crisp.

TABLE 6

| | | Working Example | | | | Comparative Example | | | | | | | |
|---|---|---|---|---|---|---|---|---|---|---|---|---|---|
| | | 1 | 2 | 3 | 4 | 1 | 2 | 3 | 4 | 5 | 6 | 7 | 8 |
| Flight (W#1) | Spin rate (rpm) | 3,070 | 2,994 | 2,919 | 2,899 | 3,109 | 3,119 | 3,168 | 3,118 | 3,166 | 3,218 | 3,183 | 3,197 |
| | Total distance (m) | 178.0 | 178.5 | 179.0 | 179.3 | 176.4 | 176.2 | 175.7 | 174.3 | 172.6 | 171.0 | 175.0 | 174.9 |
| | Rating | good | good | good | good | NG | NG | NG | NG | NG | NG | NG | NG |
| Feel | Rating | good | good | good | good | good | good | NG | good | good | good | good | good |

As demonstrated by the results in Table 6, the golf balls of Comparative Examples 1 to 8 were inferior in the following respects to the golf balls according to the invention (Working Examples).

In Comparative Example 1, the ball had a four-piece construction without an inner envelope layer. As a result, the ball did not achieve a good distance.

In Comparative Example 2, the ball had a three-piece construction without an inner envelope layer and without an outer envelope layer. As a result, the ball did not achieve a good distance.

In Comparative Example 3, the ball had a two-piece construction without an inner envelope layer, an outer envelope layer and an intermediate layer. As a result, the ball did not achieve a good distance and had a hard feel at impact.

In Comparative Example 4, the ball had a five-piece construction in which the intermediate layer was made of an ordinary ionomer. As a result, the ball did not achieve a good distance.

In Comparative Example 5, the ball had a five-piece construction in which the intermediate layer and the outer envelope layer were made of ordinary ionomer resins. As a result, the ball did not achieve a good distance.

In Comparative Example 6, the ball had a five-piece construction in which the intermediate layer, the outer envelope layer and the inner envelope layer were made of ordinary ionomer resins. As a result, the ball did not achieve a good distance.

In Comparative Example 7, the inner envelope layer was thinner than the cover and the spin rate on shots with a driver (W#1) increased. As a result, the ball did not achieve a good distance.

In Comparative Example 8, the ball had a six-piece construction in which the core was encased by five layers. As a result, the ball did not achieve a good distance.

Japanese Patent Application No. 2017-045901 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball comprising a core and four successive layers encasing the core—an inner envelope layer, an outer envelope layer, an intermediate layer and a cover, wherein the inner envelope layer, the outer envelope layer and the intermediate layer are each formed of different highly neutralized resin materials; the cover has a larger thickness than the respective thicknesses of the inner envelope layer, the outer envelope layer and the intermediate layer; and the value (A)−(B) obtained by subtracting the material hardness (B) of the softest layer among the inner envelope layer, the outer envelope layer and the intermediate layer from the material hardness (A) of the cover is a Shore D hardness of 13 or more, wherein the value obtained by subtracting the core surface hardness from the surface hardness of the inner envelope layer-encased sphere, expressed in terms of the Shore D hardness, is from 0 to 10, and the material hardness of the cover on the Shore D hardness scale is at least 58, and the material hardnesses of the respective layers and the center hardness of the core satisfy the following condition:

cover material hardness>intermediate layer material hardness>outer envelope layer material hardness>inner envelope layer material hardness>core center hardness, and wherein the golf ball has a five-piece construction consisting of the single core, the single inner envelope layer, the single outer envelope layer, the single intermediate layer and the single cover.

2. The golf ball of claim 1, wherein the material hardness of the intermediate layer on the Shore D hardness scale is from 50 to 60.

3. The golf ball of claim 1, wherein the material hardness of the outer envelope layer on the Shore D hardness scale is from 45 to 57.

4. The golf ball of claim 1, wherein the material hardness of the inner envelope layer on the Shore D hardness scale is from 40 to 52.

5. The golf ball of claim 1 wherein, letting the JIS-C hardness at the core center be Cc, the JIS-C hardness at a position 5 mm from the core center be C5, the JIS-C hardness at a position 10 mm from the core center be C10, the JIS-C hardness at a position 15 mm from the core center be C15 and the JIS-C hardness at the core surface be Cs, the core has a hardness profile which satisfies the following relationships (i) to (vi):

$$18 \leq Cs - Cc \quad \text{(i)}$$

$$0 \leq C10 - Cc \leq 10 \quad \text{(ii)}$$

$$C10 - Cc < Cs - C10 \quad \text{(iii)}$$

$$10 < Cs - C10 \quad \text{(iv)}$$

$$Cs \geq 68 \quad \text{(v)}$$

$$Cc \geq 48 \quad \text{(vi)}.$$

6. The golf ball of claim 5, wherein Cs is from 68 to 80, C15 is from 64 to 78, C10 is from 56 to 67, C5 is from 52 to 63, Cc is from 48 to 62, Cs−C15 is from 1 to 9, C15−C10 is from 4 to 15, C10−C5 is from 1 to 7, C5−Cc is from 0 to 7, (Cs−C10)/(C10−Cc) is from 1.0 to 5.0, and Cs−Cc is from 14 to 30.

7. The golf ball of claim 1, wherein the core has a deflection when compressed under a final load of 1,275 N (130 kgf) from an initial load of 98 N (10 kgf) that is at least 4.0 mm.

8. The golf ball of claim 1, wherein the core diameter, intermediate layer thickness and cover thickness satisfy the following relationship:

cover thickness>intermediate layer thickness<core diameter.

9. The golf ball of claim 1, wherein the initial velocities of the sphere (I) consisting of the core encased by the inner envelope layer, the sphere (II) consisting of sphere (I) encased by the outer envelope layer, the sphere (III) consisting of sphere (II) encased by the intermediate layer, and the ball satisfy the following relationships:

ball initial velocity Sphere (*III*) initial velocity>Sphere (*II*) initial velocity Sphere (*I*) initial velocity; and ball initial velocity>core initial velocity.

10. The golf ball of claim 1, wherein at least 50 wt % of the total amount of cover material is a high-acid ionomer resin having an acid content of at least 16 wt %.

11. The golf ball of claim 1, wherein the core is formed from a rubber composition containing compounding ingredients (A) to (C) shown below:

(A) a base rubber (B) an organic peroxide (C) water and/or a metal monocarboxylate.

12. The golf ball of claim 11, wherein the component (C) is water and the amount of water included per 100 parts by weight of the base rubber is from 0.1 to 5 parts by weight.

13. The golf ball of claim 6, wherein (Cs−C10)/(C10−Cc) is from 1.0 to 2.8.

14. The golf ball of claim 1, wherein the intermediate layer has a thickness of from 0.4 to 1.0 mm.

15. The golf ball of claim 1, wherein the thicknesses of the respective layers and the core diameter satisfy the following condition:

the cover thickness>the intermediate layer thickness<the envelope layer outside thickness<the envelope layer inside thickness<the core diameter.

16. The golf ball of claim 1, wherein the (cover thickness)/(inner envelope layer thickness) value is from 1.1 to 1.8 and the (cover thickness)/(outer envelope layer thickness) value is from 1.1 to 1.8.

17. The golf ball of claim 1, wherein the total thickness of the layers encasing the core (the cover thickness+the intermediate layer thickness+the outer envelope layer thickness+the inner envelope layer thickness) value is from 3.5 to 5.0 mm.

18. The golf ball of claim 1, wherein the value obtained by subtracting the surface hardness of the intermediate layer-encased sphere from the surface hardness of the ball, expressed in terms of the Shore D hardness, is from 3 to 15.

* * * * *